United States Patent [19]

Lesea

[11] Patent Number: 5,028,846

[45] Date of Patent: Jul. 2, 1991

[54] SINGLE-ENDED BALLAST CIRCUIT

[75] Inventor: Ronald A. Lesea, Redwood City, Calif.

[73] Assignee: GTE Products Corporation, Danvers, Mass.

[21] Appl. No.: 541,258

[22] Filed: Jun. 20, 1990

[51] Int. Cl.[5] ..... H05B 41/24

[52] U.S. Cl. ..... 315/219; 315/209 R; 315/244

[58] Field of Search ..... 315/219, 209 R, 244, 315/243; 363/18

[56] References Cited

U.S. PATENT DOCUMENTS

| | | | |
|---|---|---|---|
| 2,982,881 | 5/1961 | Reich | 315/241 R |
| 4,246,515 | 1/1981 | Schauffele | 315/219 |
| 4,257,088 | 3/1981 | Nilssen | 315/243 |
| 4,348,615 | 9/1982 | Garrison et al. | 315/219 |
| 4,415,839 | 11/1983 | Lesea | 315/216 |
| 4,486,821 | 12/1984 | Itakura | 363/18 |
| 4,544,863 | 10/1985 | Hashimoto | 315/244 |
| 4,559,478 | 12/1985 | Fuller et al. | 315/219 |
| 4,581,562 | 4/1986 | Nilssen | 315/219 |
| 4,613,796 | 9/1986 | Bay | 315/219 |
| 4,698,741 | 10/1987 | Pacholok | 315/241 R |
| 4,806,830 | 2/1989 | Ueki | 315/209 R |

*Primary Examiner*—Eugene R. Laroche
*Assistant Examiner*—Tan Xuan Dinh
*Attorney, Agent, or Firm*—Thomas E. Schatzel

[57] ABSTRACT

A single-ended ballast circuit employs a power-factor-correcting network (510); a DC power supply (512); a free-running oscillator (516); a transistor (518); a current-limiting (ballasting) network (520); and two fluorescent lamps (524). The transistor (518) is configured as a switch connected to be responsive to a signal generated (630) by the oscillator (516) and operative to periodically couple a line (734) to a circuit common. The current-limiting (ballasting) network (520) includes an inductor or transformer (740) having a primary winding (744), connected between a DC power-supply potential and the line (734), and a secondary winding (746); a first capacitor (750), connected between the line (734) and circuit common; an inductor (752); a second capacitor (756), connected in series with the inductor (752) across the secondary winding (746); and a third capacitor (754), connected in series with the lamps (524) across the second capacitor (756).

9 Claims, 3 Drawing Sheets

SINGLE-ENDED BALLAST CIRCUIT

TECHNICAL FIELD

The present invention relates to the field of energy conversion for lighting generally and more particularly to an electronic ballast suitable for use with gaseous-discharge lamps.

BACKGROUND ART

Gaseous-discharge lamps, lamps in which light is generated when an electric current, or discharge, is passed through a gaseous medium, are not new to the lighting field. Fluorescent-type gaseous-discharge lamps have been employed for years to provide relatively efficient indoor lighting, such as for office buildings.

Unlike incandescent lamps, which are self limiting as a result of their positive-resistance characteristics, gaseous-discharge lamps have a negative-resistance characteristic. For this reason, gaseous-discharge lamps are operated in conjunction with a ballast, which provides the requisite current limiting. Traditionally, ballasts are of core and coil construction. One form is that of a simple choke, which provides an inductive impedance for current limiting. Another form is that of a transformer. The transformer form permits voltage conditioning, such as providing a high break-down potential, which is required for starting instant-start-type fluorescent lamps by ionizing to a plasma the gas therein. For rapid-start-type fluorescent lamps, the transformer includes a pair of windings for energizing the lamp filaments and, separating the pair of filament windings, a high-voltage winding having a high reactance for current limiting. Additionally, a magnetic shunt may be included in the transformer to limit the energy transferred through the magnetic path.

Unfortunately, traditional core-and-coil-type ballasts are relatively inefficient, having substantial heat generating losses that are generally equally divided between copper losses in the coil and core losses in the relatively inexpensive grades of iron employed therein. For example, it is not unusual for a traditional core-and-coil-type ballast employed in a dual 40 watt lamp fixture to dissipate from 15 to 20 watts, causing the ballast to run quite hot. Further, in many applications, such as in office buildings, this ballast-generated heat must be removed by air conditioning equipment, which is itself relatively inefficient. Another problem is that core-and-coil-type ballasts are relatively heavy, requiring that associated fixtures be more substantial than would otherwise be necessary.

The regulation afforded by traditional core-and-coil-type ballasts is, also, relatively poor. Typically, the operating level of fluorescent fixtures employing such ballasts varies as the square of the power-line voltage. Thus, in many applications, excessive lighting, dissipating excessive power, is often employed to insure that minimum lighting levels are achieved.

Among other problems associated with gaseous-discharge lamps is that they are less efficient when operated at the normal 60 Hz line frequency that when they are operated at higher frequencies. Fluorescent lamps are often difficult to start when cold and, as a result, flicker for some time. Fluorescent lamps require core-and-coil-ballast phasing both to reduce stroboscopic effects and to increase the power factor such lamps present to the AC power line via the ballast.

These problems are overcome by my "Electronic Ballast For Gaseous Discharge Lamps," which is disclosed in the U.S. Pat. No. 4,415,839. Briefly, the above mentioned ballast employs a power-factor-correcting network; a DC power supply; a pair of transistors (switches); a pulse generator; and a current-limiting network. To improve the power factor the DC power supply presents to an AC power line (by restricting the amount of power the DC power supply can obtain from the AC power line during peaks of the line cycle), the DC power supply is connected in series with the power-factor-correcting network across a 120 volt, 60 Hz, AC power line. The DC power supply is of a voltage-doubler type which develops on one line a twice-peak-potential level and which develops on another line a potential level one half the twice-peak-potential level, both with respect to a reference-potential level developed on vet another line. The transistors (switches) are connected in a totem-pole configuration in which the channels of the transistors are connected in series between the twice-peak-potential-level line and the reference-potential-level line. The pulse generator is configured to drive the gates of the transistors, in turn, so as to develop at a line at the juncture of the transistors, a source of high-frequency AC power, the waveform of which approximates a square wave. The current-limiting network is configured to couple one, or more, fluorescent lamps between the high-frequency AC power-source line and the return line. In one embodiment, the current-limiting network includes an inductor connected between the high-frequency AC power-source line and a node, a capacitor connected between the node and the return line, and another inductor connected in series with the lamp(s) between the node and the return line.

The above mentioned ballast is disadvantageous in that it provides little isolation from the AC power line. As a consequence, the above mentioned ballast may pose a safety hazard (danger of electrocution) to all who come in contact there with. Further, the above mentioned ballast is relatively complex and expensive.

The U.S. Pat. No. 4,613,796 of D. Bay discloses a "Single Transistor Oscillator Ballast Circuit" which employs a transistor connected as a switch in a inductive, shunt feed configuration. More specifically, the transistor in the D. Bay patent is connected in a self-oscillatory configuration. The emitter of the transistor is connected to circuit ground; and, the collector of the transistor is connected to one end of a transformer primary winding, the distal end of which is connected in series with a ballast inductor to a power supply potential. A capacitor is connected across the transistor between the transistor collector and emitter. In addition, a capacitor is connected across one secondary winding of the transformer; and, a number of capacitors are connected, each in series with a respective one of a number of lamps across the secondary winding.

The U.S. Pat. No. 4,257,088 of O. Nilssen discloses a "High-Efficiency Single-Ended Inverter Circuit" which, also, employs a transistor connected as a switch in a inductive, shunt feed configuration. More specifically, the transistor in the 0. Nilssen patent is connected in a self-oscillatory configuration. The emitter of the transistor is connected to circuit ground; and, the collector of the transistor is coupled by a rectifier, the primary winding of a transformer, and another transformer primary winding to a power supply potential. A capacitor is connected across the combination of the rectifier and the transistor from the rectifier winding juncture and circuit ground. In addition, a capacitor is connected in series with a load from the rectifier winding juncture to circuit ground. It is indicated in the 0. Nilssen patent that the purpose of the rectifier is to permit the voltage Vc to reach negative values. If the load requirements are such that a negative Vc is not necessary, this rectifier may be eliminated. In addition, it is indicated in the 0. Nilssen patent that resonant interchange of energy occurs between the inductor and the tank capacitor. Finally, it is indicated in the in the 0. Nilssen patent that the load may comprise a ballast for a fluorescent lamp.

The U.S. Pat. No. 4,348,615 of R. Garrison et al discloses the combination of an oscillator, a transistor, and a network, all configured to drive a fluorescent lamp. More specifically, in the R. Garrison et al patent, the transistor is configured with the transistor base connected to the oscillator, with the transistor emitter connected to circuit ground, and with the transistor collector coupled by an inductance winding to a power supply potential.

The U.S. Pat. No. 4,559,478 of R, Fuller et al discloses a transistor configured with the transistor emitter connected to circuit ground and the transistor collector coupled by a transformer winding to a power supply potential. In addition, the R, Fuller et al patent disclose the series combination of a transformer winding, a capacitor, and a lamp connected from the transistor transformer winding juncture to circuit ground.

The reader may find of interest the U.S. Pat. No. 2,982,881 of R. Reich; the U.S. Pat. No 4,246,515 of C. Schauffele; the U.S. Pat. No. 4,486,821 of H. Itakura; the U.S. Pat. No. 4,581,562 of O. Nilssen; and the U.S. Pat. No. 4,698,741 of D. Pacholok.

DISCLOSURE OF THE INVENTION

It is therefore the primary object of the present invention to provide a gaseous-discharge-lighting system which is safe.

Another object of the present invention is to provide a gaseous-discharge-lighting system which is relatively simple and inexpensive.

Still another object of the present invention is to provide a a gaseous-discharge-lighting system which is relatively efficient.

Yet another object of the present invention is to provide a network which presents a relatively high power factor to a high-frequency AC power source.

Briefly, the presently preferred embodiment of a single-ended ballast circuit in accordance with the present invention employs a power-factor-correcting network (510); a DC power supply (512); a free-running oscillator (516); a transistor (518); a current-limiting (ballasting) network (520); and two fluorescent lamps (524). The transistor (518) is configured as a switch connected to be responsive to a signal generated (630) by the oscillator (516) and operative to periodically couple a line (734) to a circuit common. The current-limiting (ballasting) network (520) includes an inductor or transformer (inductive means) (740) having a primary winding (744), connected between a DC power-supply potential and the line (734), and a secondary winding (746); a first capacitor (750), connected between (734) and circuit common; an inductor (752); a second capacitor (756), connected in series with the inductor (752) across the secondary winding (746); and a third capacitor (754), connected in series with the lamps (524) across the second capacitor (756).

These and other objects of the present invention will no doubt become apparent to those skilled in the art after having read the detailed description of the presently preferred embodiment of the present invention which is illustrated in the figures of the drawing.

BRIEF DESCRIPTION OF THE FIGURES IN THE DRAWING

BEST MODE FOR CARRYING OUT THE INVENTION

Figure 1:
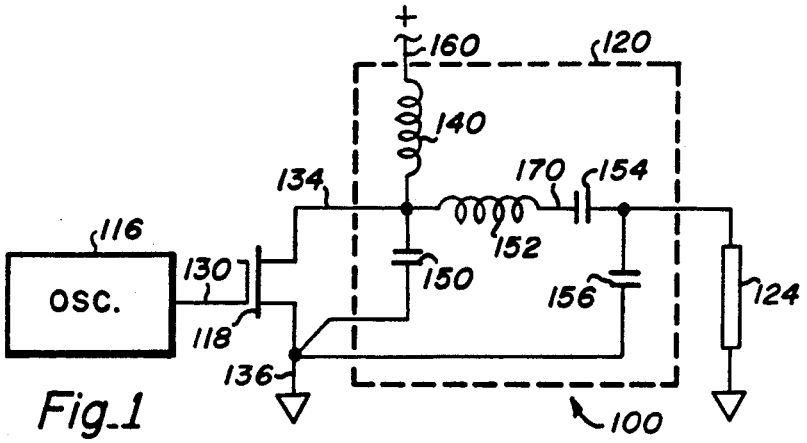
FIG. 1 is a schematic diagram of one embodiment of a single-ended ballast circuit in accordance with the present invention.

Illustrated in FIG. 1 of the drawing, generally designated by the number 100, is one embodiment of a single-ended ballast circuit in accordance with the present invention. Ballast circuit 100 employs a power-factor-correcting network (not shown); a power supply (also, not shown) a free-running oscillator, that is designated 116; a field effect transistor (FET), that is designated 118; a current-limiting (ballasting) network, that is designated 120; and one, or more, fluorescent lamps, which are represented by a lamp that is designated 124. Oscillator 116 is configured to generate on a line, designated 130, a high-frequency signal, having, preferably, a square-wave shape. Transistor 118 is configured as a switch connected to be responsive to the high-frequency signal generated on line 130 by oscillator 116 and operative to periodically couple a line 134 to a line 136, which is connected to a circuit common. More specifically, transistor 118 is configured with the transistor gate connected to line 130; with the transistor drain connected to line 134; and with the transistor source coupled bv line 136 to circuit common.

Current-limiting (ballasting) network 120 includes an inductor (or other inductive means), designated 140; a capacitor, designated 150; another inductor 152; another capacitor 154; and, yet, another capacitor 156. Inductor 140 is configured with one end of the inductor coupled bv a line 160 to a power-supply potential (source) and with the other (distal) end of the inductor connected to the drain of transistor 118 (line 134). Capacitor 150 is connected between the drain of transistor 118 [line 134) and a point of low high-frequency AC impedance. In that regard the source of transistor 118 (line 136) is preferred (over, for example, power-supply potential line 160). In other words, preferably, capacitor 150 is connected between the drain and source (across the channel) of transistor 118. Inductor 152 is connected between the drain of transistor 118 (line 134) and a line 170. In this embodiment, capacitor 154 is connected in series with the fluorescent lamp(s), represented by lamp 124, between line 170 and circuit common (line 136). Also, in this embodiment, capacitor 156 is connected across (in parallel with) the fluorescent lamp(s), represented by lamp 124.

Inductor 140, of current-limiting (ballasting) network 120, among other things, is operative to provide an inductive power-supply feed for transistor 118.

Inductor 140, capacitor 150, inductor 152, and capacitor 156, of current-limiting network 120, are operative to provide an impedance transformation. They provide the desired open circuit output voltage for starting the fluorescent lamp(s), represented bv lamp 124. In addition, they provide the desired source impedance, as seen by the lamp(s). Also, they establish the operating Q for the desired output waveform. Further, they provide the desired load impedance and phase angle, as seen by transistor 118 for both the operating and open circuit conditions.

Capacitor 154, of current-limiting network 120, is operative to provide DC blocking to prevent a DC current attributable to charge flowing from the power-supply potential, through inductors 140 and 152, and through the fluorescent lamp(s) represented by lamp 124. Unfortunately, the capacitive reactance of capacitor 154 affects the impedance transformation provided bv inductor 140, capacitor 150, inductor 152, and capacitor 156, of current-limiting network 120. To minimize this affect, preferably, for capacitor 154, a capacitor is employed having a relatively large capacitance and, thus, a relatively small capacitive reactance. To cancel the residual capacitive reactance of capacitor 154 (at least at the fundamental of the oscillator 116 frequency), preferably, the (inductance and, thus, the) inductive reactance of inductor 152 (at that frequency) is increased bv the amount of the residual capacitive reactance of the capacitor (at that frequency) over the amount which would be employed for the inductor in the absence of the capacitor.

Figure 2:
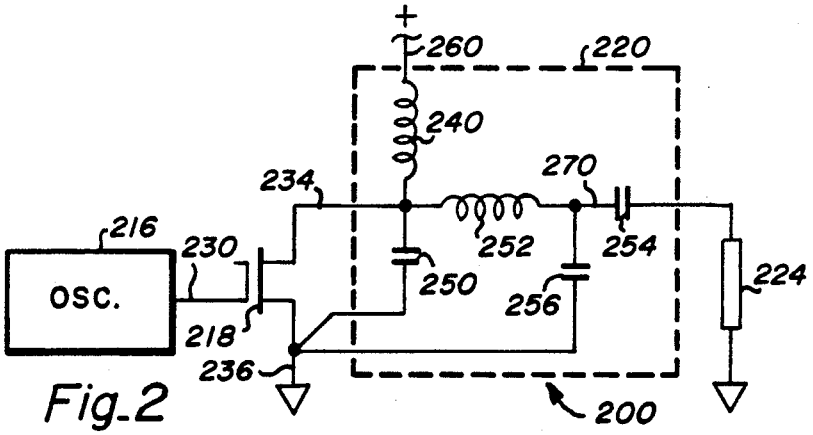
FIG. 2 is a schematic diagram of another embodiment of a single-ended ballast circuit in accordance with the present invention.

Another embodiment of a single-ended ballast circuit in accordance with the present invention is illustrated in FIG. 2 of the drawing generally designated bv the number 200. In this embodiment, the configuration of capacitors 154 and 156 (shown in FIG. 1) is changed. More specifically, in this embodiment, an inductor 252 and a capacitor 256 are connected in series across the channel of the transistor (from a line 234 to a line 236, which is connected to a circuit common).

The configuration of capacitors 254 and 256 (shown in FIG. 2) is advantageous over the configuration of capacitors 154 and 156 (shown in FIG. 1) in that there is less VA stress on capacitor 254 than on capacitor 154 (capacitor 254 conducting the charge attributable to the output current only, as opposed to the charge attributable to the output plus shunt currents conducted by capacitor 154).

Figure 3:
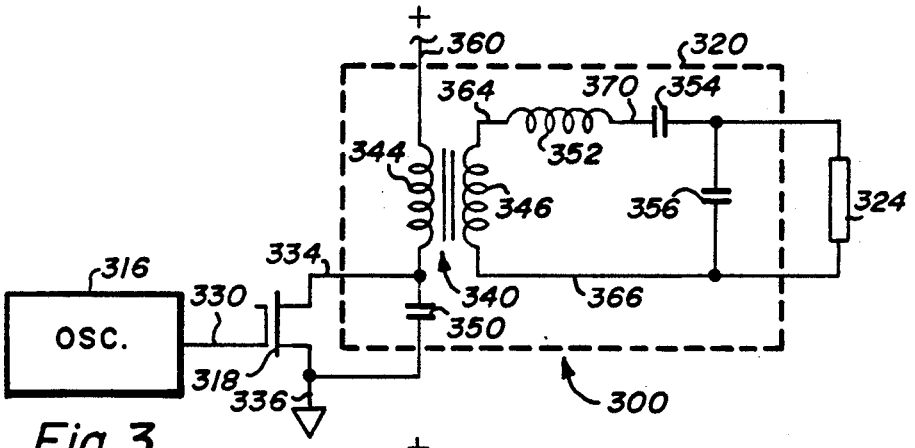
FIG. 3 is a schematic diagram of yet another embodiment of a single-ended ballast circuit in accordance with the present invention.

Unfortunately, the embodiments illustrated in FIGS. 1 and 2 present a risk of electrocution in that one end of (one of) the lamp(s), represented bv lamp 124, is directly connected to the power-supply return (circuit common) (line 136). To avoid this problem, in an embodiment of a single-ended ballast circuit in accordance with the present invention, which is illustrated in FIG. 3 of the drawing generally designated bv the number 300, a transformer is substituted for inductor 140 (shown in FIG. 1). More specifically, ballast circuit 300 (shown in FIG. 3) employs a power-factor-correcting network (not shown); a power supply (also, not shown) a free-running oscillator 316; a field effect transistor (FET) 318; a current-limiting (ballasting) network 320; and one, or more, fluorescent lamps, which are represented by a lamp that is designated 324. Transistor 318 is configured with the transistor gate coupled by a line 330 to the output of oscillator 316; with the transistor drain connected to a line 334; and with the transistor source coupled by a line 336 to circuit common.

Current-limiting (ballasting) network 320 includes a transformer (inductive means), designated 340, having a primary winding 344 and a secondary winding 346; a capacitor 350; an inductor 352; another capacitor 354; and, yet, another capacitor 356. Transformer 340 is configured with one end of the transformer primary winding (344) coupled by a line 360 to a power-supply potential (source); with the other (distal) end of the transformer primary winding (344) connected to the drain of transistor 318 (line 334); with one end of the the transformer secondary winding (346) connected to a line 364; and with the other (distal) end of the transformer secondary winding (346) connected to a line 366. Capacitor 350 is connected between the drain of transistor 318 (line 334) and, preferably, the source of transistor 318 (line 336). Inductor 352 is connected between line 364 and a line 370. In this embodiment, capacitor 354 is connected in series with the fluorescent lamp(s), represented by lamp 324, between lines 370 and 366. Also, in this embodiment, capacitor 356 is connected across (in parallel with) the fluorescent lamp(s), represented by lamp 324.

Transformer 340 of current-limiting (ballasting) network 320 (shown in FIG. 3) functions much as inductor 140 (shown in FIG. 1) in that the transformer provides an inductive power-supply feed for, in this case, transistor 318. Further, transformer 340 functions much as inductor 140 in that the transformer provides an inductive reactance which, with the capacitive reactance of capacitor 350, the inductive reactance of inductor 352, and the capacitive reactance of capacitor 356 (all of current-limiting network 320), provide the impedance transformation between transistor 318 and the fluorescent lamp(s) represented by lamp 324. Unlike inductor 140, transformer 340 also provides isolation from the AC power-supply lines for the fluorescent lamp(s) represented by lamp 324. Further, unlike inductor 140, transformer 340 also provides an extra degree of design freedom for the realization of the components of current-limiting network 320.

As previously indicated, capacitor 154 is employed in the embodiment shown in FIG. 1 to prevent a DC current attributable to charge flowing from the power-supply potential through the fluorescent lamp(s). In the embodiment shown in FIG. 3, transformer 340 prevents such a DC current. However, capacitor 354 prevents a DC current attributable to charge flowing through secondary winding 346, inductor 352, and the fluorescent lamp(s), saturating the core(s) of transformer 340 and/or inductor 352. The latter, DC, current would, otherwise, exist were one of the cathodes of one of the lamp(s) to fail so as to cause loss of heating of one end of the lamp so as to cause the lamp to rectify.

Figure 4:
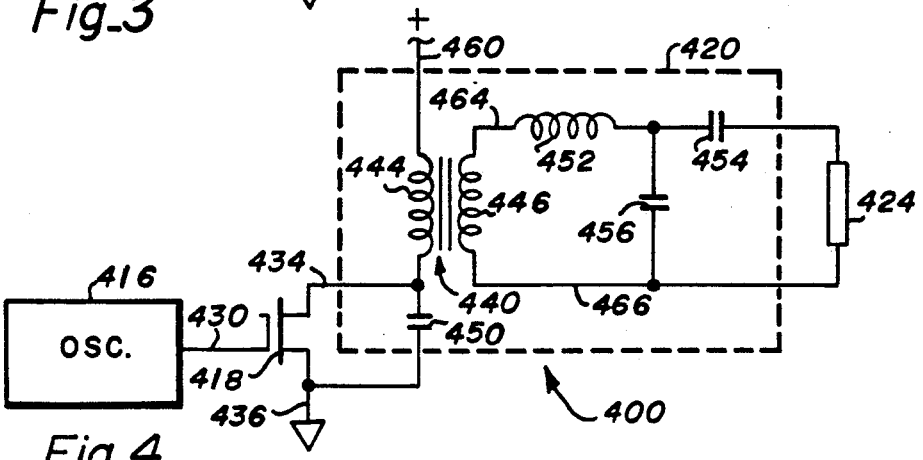
FIG. 4 is a schematic diagram of still another embodiment of a single-ended ballast circuit in accordance with the present invention.

Yet another embodiment of a single-ended ballast circuit in accordance with the present invention is illustrated in FIG. 4 of the drawing generally designated by the number 400. Again, in this embodiment, the configuration of capacitors 354 and 356 (shown in FIG. 3) is changed. More specifically, in this embodiment, an inductor 452 and a capacitor 456 are connected in series across the secondary (446) of the transformer (440) (from a line 464 to a line 466).

Again, the configuration of capacitors 454 and 456 (shown in FIG. 4) is advantageous over the configuration of capacitors 354 and 356 (shown in FIG. 3) in that there is less VA stress on capacitor 454 than on capacitor 354 (capacitor 454 conducting the charge attributable to the output current only, as opposed to the charge attributable to the output plus shunt currents conducted by capacitor 354).

Figure 5:
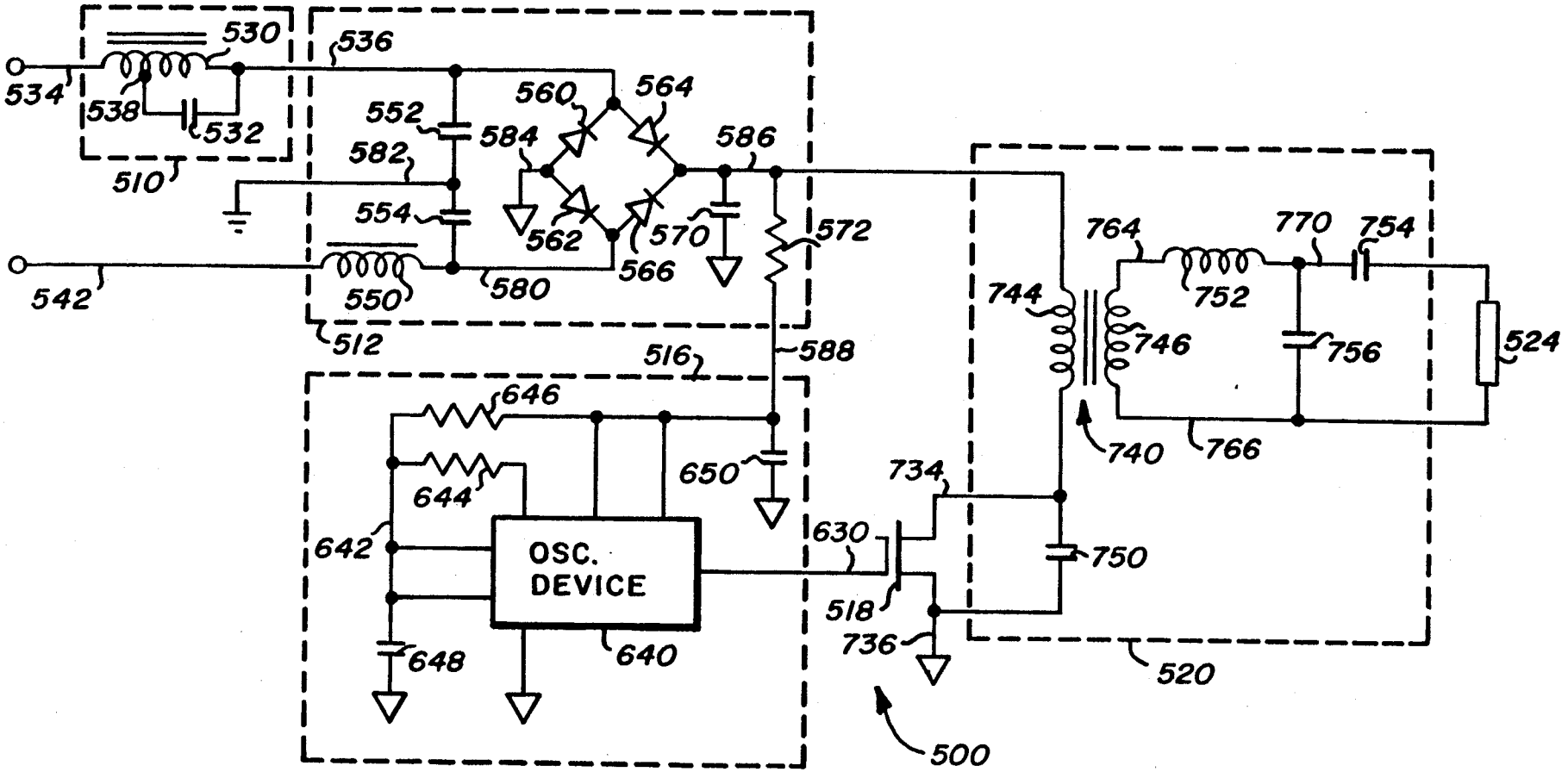
FIG. 5 is a schematic diagram of the presently preferred embodiment of a single-ended ballast circuit in accordance with the present invention.

The presently preferred embodiment of a single-ended ballast circuit in accordance with the present invention is illustrated in FIG. 5 of the drawing, generally designated by the number 500. Ballast circuit 500 employs a power-factor-correcting network 510; a DC power supply 512; a free-running oscillator 516; a MOS-type field effect transistor (FET) 518; a current-limiting (ballasting) network 520; and two fluorescent lamps, which are represented by a lamp that is designated 524. Power-factor correcting network 510 includes a tapped inductor 530 and a capacitor 532. Inductor 530 is configured with one (distal) end of the inductor connected to a line 534 and with the other (distal) end of the inductor connected to a line 536. Capacitor 532 is configured with one end of the capacitor coupled by a line 538 to the inductor 530 tap and with the other end of the capacitor connected to line 536. In the presently preferred embodiment, for use with 120 volt AC power, inductor 530 has 600 turns of number 26 AWG wire wound on a core of the type which is commonly designated EI-21. The winding is tapped 1:9 (60 turns to 540 turns) such that 540 turns are across (in parallel with) capacitor 532. Preferably, capacitor 532 has a capacitance of 3.3 mfd.

DC power supply 512 is configured with the inputs of the power supply connected in series with power-factor-correcting network 512 across an AC power line to improve the power factor the DC power supply presents to the AC power line (by restricting the amount of power the DC power supply can obtain from the AC power line during peaks of the line cycle). In other words, one input of DC power supply 512 is connected to line 536; line 534 is connected to one side of an AC power line; and the other input of the DC power supply is coupled by a line 542 to the other side of the AC power line. DC power supply 512 includes an RFI choke 550; a pair of RFI capacitors, respectively designated 552 and 554; four rectifier diodes, respectively designated 560, 562, 564, and 566; a filter capacitor 570; and a current limiting resistor 572. The RFI components are configured with choke 550 connected between line 542 and a line 580, with capacitor 552 connected between line 536 and a line 582, and with capacitor 554 connected between lines 582 and 580. Line 582 is connected to an earth ground. The rectifier diodes are connected in a bridge configuration with the anode of diode 560 connected to a line 584, with the cathode of diode 560 connected to line 536, with the anode of diode 562 connected to line 584, with the cathode of diode 562 connected to line 580, with the anode of diode 564 connected to line 536, with the cathode of diode 564 connected to a line 586, with the anode of diode 566 connected to line 580, and with the cathode of diode 566 connected to a line 586. Line 584 is connected to a circuit common. Filter capacitor 570 is connected between line 586 and circuit common; and current-limiting resistor 572 is connected between line 586 and a line 588. In the presently preferred embodiment, for operation from a 120 volt AC power line, RFI choke 550 has an inductance of 1.0 mH; RFI capacitors 552 and 554 each have a capacitance of 0.0068 mfd; rectifier diodes 560, 562, 564, and 566 are each of the type which is commonly designated 1N4006, filter capacitor 570 has a capacitance of 100 mfd; and current limiting registor 572 has a resistance of 6800 ohms and a size of 5 watts. As a consequence, DC power-supply 512 develops on lien 586 a DC potential of 130 volts and develops on line 588 a DC potential Oscillator 516, which is of the free-running type, is configured to generate on a line, designated 630, a high-frequency signal, having, preferably, a square-wave shape. In the presently preferred embodiment, oscillator 516 is configured around an integrated-circuit-type device 640, which is of the type that is commonly designated 555 (and designated LM555 by National Semiconductor Inc.). Specifically, device 640 is configured with the device pin 1 connected to circuit common, with device pins 2 and 6 connected to a line 642, with device pins 4 and 8 connected to line 588, and with device pin 3 connected to line 630. Pin 7 of the device is coupled by a frequency establishing resistor 644 to line 642, which is coupled to line 588 by another frequency establishing resistor 646 and to circuit common by a frequency establishing capacitor 648. A bypassing capacitor 650 couples line 588 to circuit common. Preferably, capacitor 650 has a capacitance of 10 mfd; and, resistors 644 and 646 and capacitor 648 have component values chosen such that device 640 generates a high-frequency square-wave signal of 42.5 kHz on line 630.

Transistor 518 is configured as a switch connected to be responsive to the high-frequency signal generated on line 630 by oscillator 516 and operative to periodicaly couple a line 734 by a line 736, which is connected to circuit common. More specifically, transistor 518 is configured with the transistor gate connected to line 630; with the transistor drain connected to line 734; and with the transistor source coupled by line 736 to circuit common. Preferably, transistor 518 is of the type which is designated IRF830 by International Rectifier, Inc. (An IRF830 transistor has a BVDSS of 500 volts and an RDS(on) of 1.5 ohms.)

Current-limiting (ballasting) network 520 includes a transformer (inductive means), designated 740, having a primary winding 744 and a secondary winding 746; a capacitor 750; an inductor 752; another capacitor 754; and yet, another capacitor 756. Transformer 740 is configured with one end of the transformer primary winding (744) coupled by line 586 to DC power-supply 512; with the other (distal) end of the transformer primary winding (744) connected to the drain of transistor 518 (line 734); with one end of the the transformer secondary winding (746) connected to a line 764; and with the other (distal) end of the transformer secondary winding (746) connected to a line 766. Capacitor 750 is connected between the drain of transistor 518 (line 734) and, preferably, the source of transistor 518 (line 736). Inductor 752 is connected between line 764 and a line 770. In this embodiment, capacitor 756 is connected between lines 770 and 766. Also, in this embodiment, capacitor 754 is connected in series with the fluorescent lamps, represented by lamp 524, between lines 770 and 766 (in parallel with capacitor 756).

Preferably, the lamps represented by lamp 524 include the series connection of two FO32-T8 Octron lamps. Lamp cathode heating is provided by three one-turn windings on transformer 740 (not shown).

Again, transformer 740, of current-limiting (ballasting) network 520, among other things, is operative to provide an inductive power-supply feed for transistor 518.

Transformer 740, capacitor 750, inductor 752, and capacitor 756, of current-limiting network 520, again, are operative to provide an impedance transformation. They, also, provide the desired open circuit output voltage for starting the fluorescent lamps; represented by lamp 524. In addition, they provide the desired source impedance, as seen by the lamps. Also, they establish the operating Q for the desired output waveform. Further, they provide the desired load impedance and phase angle, as seen by transistor 518 for both the operating and open circuit conditions.

Capacitor 754 prevents a DC current attributable to charge flowing through secondary winding 746, inductor 752, and the fluorescent lamps, from saturating the core(s) of transformer 740 and/or inductor 752. The latter, DC, current would, otherwise, exist were one of the cathodes of one of the lamps to fail so as to cause loss of heating of one end of the lamp so as to cause the lamp to rectify.

Preferably, for operation from a 120 volt AC power line, transformer 740 has a turns ratio of 1:1,4 wound on a core of the style which is designated PQ and the material which is designated H7Cl by TDK, Inc. so as to achieve a primary inductance of 0.890 mH. Also, preferably, inductor 752 has an inductance of 3.63 mH; capacitor 754 has a capacitance of 0.047 mfd; and, capacitor 756 has a capacitance of 0.004 mfd; As a consequence, transistors 518 draws a peak current of 2.0 amperes, develops a peak voltage of 425 volts on line 734, and provides 53 watts of power for driving the lamps, represented by lamp 524.

When transistor 518 is turned on, a current is established by charge flowing from DC power-supply 512 through primary winding 744 of transformer 740. Charge also flows through transformer 740 due to energy stored in capacitor 750, inductor 752, and capacitors 752, 754, and 756. The configuration is such that the current due to charge flowing in primary winding 744 of transformer 740 is not discontinuous (as in a flyback configuration) nor sinusoidal (as in certain RF amplifier configurations). With these component values, when transistor 518 is turned on, the current due to the charge which flows from DC power-supply 512 through primary winding 744 of transformer 740 has a triangular shape with smooth inverse parabolic corners. While transistor 518 is on, the voltage drop across the transistor is very nearly zero. Transistor 518 is turned off when the charge flow through the transistor is near the peak of the inverse parabolic waveform. When transistor 518 is turned off, across the transistor a voltage is developed, the shape of which approximates a half-sine wave in shape. With these component values, transistor 518 does not turn back on until after the (half-sine wave shaped) voltage has reached zero and the residual current-limiting network 520 energy has caused a short reversal in the intrinsic transistor drain-source diode. Thus, with a square-wave drive, transistor 518 conducts current for 50 percent of the total period. The half-sine-wave voltage waveform developed across transistor 518 appears at secondary winding 746 of transformer 740 multiplied in magnitude in proportion to the transformer turns ratio.

Figure 6:
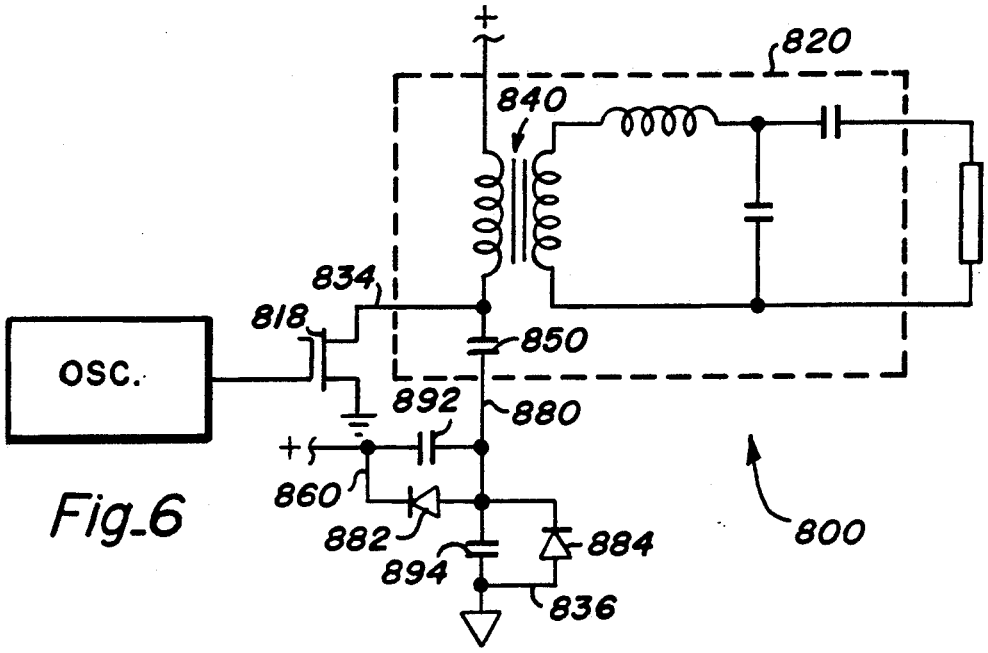
FIG. 6 is a schematic diagram of yet another embodiment of a single-ended ballast circuit in accordance with the present invention.

Another embodiment of a single-ended ballast circuit in accordance with the present invention is illustrated in FIG. 6 of the drawing generally designated by the number 800. In this embodiment, rather than being connected to the source of the transistor (818), the capacitor (850), which corresponds to capacitor 750 (shown in FIG. 5), is connected to a line 880. A pair of clamping diodes are included, one, which is designated 882, being configured with the diode anode connected to line 880 and the diode cathode connected to the DC power-supply potential (860) and the other one, which is designated 884 being configured with the diode cathode connected to line 880 and the diode anode connected to a circuit common (836). A capacitor, designated 892, is connected in parallel with diode 882; and, a capacitor, designated 894, is connected in parallel with diode 884. The diode-capacitor configuration limits the peak level of the potential developed on the line (834) connected to the juncture of the transistor (818) and capacitor 850, returning energy to the DC power supply. As a consequence, these components provide a safety margin protecting the transistor (818) and capacitor 850 and preventing saturation of the core of the transformer (840).

Figure 7:
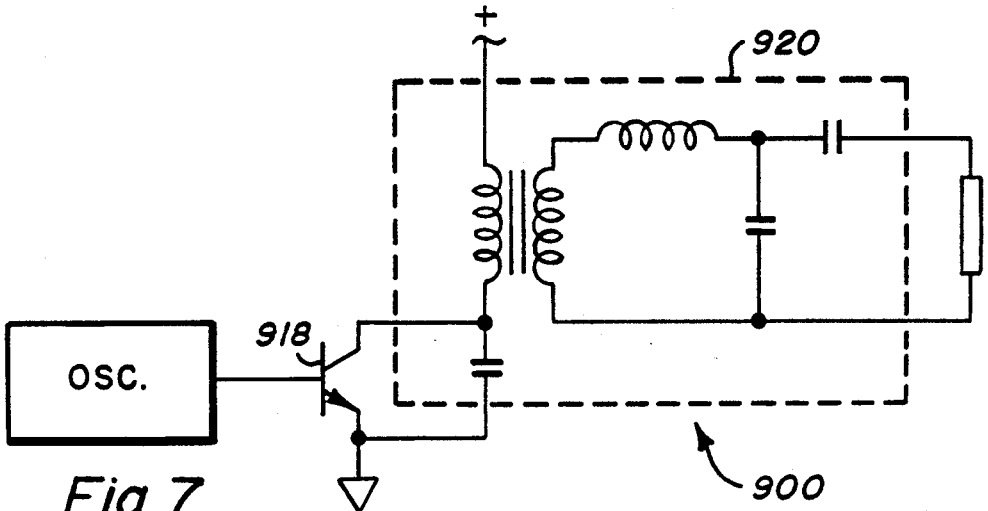
FIG. 7 is a schematic diagram of still another embodiment of a single-ended ballast circuit in accordance with the present invention.
Figure 8:
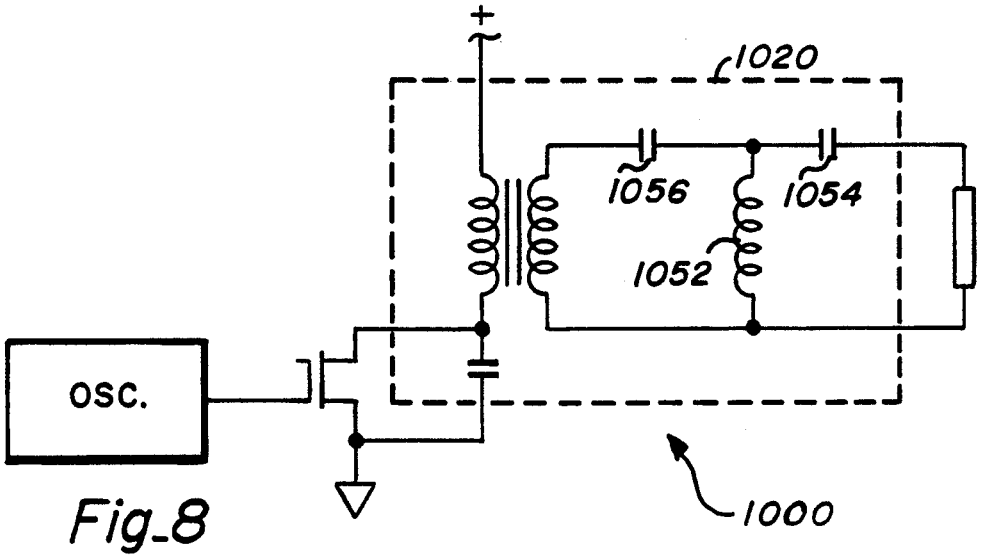
FIG. 8 is a schematic diagram of another embodiment of a single-ended ballast circuit in accordance with the present invention.

In an embodiment of a single-ended ballast circuit in accordance with the present invention which is illustrated in FIG. 7 of the drawing generally designated by the number 900, a bipolar transistor 918 is employed; and, in an embodiment of a single-ended ballast circuit in accordance with the present invention illustrated in FIG. 8 of the drawing generally designated by the number 1000, the components of the current-limiting network (1020), (which are designated 752, 754, and 756 in FIG. 5) are configured in a "high-pass-T" configuration.

It is contemplated that after having read the preceding disclosure, certain alterations and modifications of the present invention will no doubt become apparent to those skilled in the art. It is therefor intended that the following claims be interpreted to cover all such alterations and modifications as fall within the true spirit and scope of the invention.

What is claimed is:

1. A ballast circuit for driving at least one gaseous discharge lamp (124), the ballast circuit comprising in combination;

means for developing a DC power-supply potential (160) with respect to a circuit common (136);

an oscillator (116) for generating a high-frequency oscillator signal (130);

a line (134);

a transistor (118) connected to said oscillator (116), to said line (134), and to said circuit common (136), said transistor being configured as a switch responsive to said oscillator generated signal (13) and operative to periodically couple said line (134) to said circuit common (136); and a current-limiting network (120) including, first inductor means (140) connected between said DC power-supply potential (160) and said line (134), first capacitor means (150) connected between said line (134) and said circuit common (136), second capacitor means (156) having a first end for connection with the lamp (124) and a second end connected to said circuit common (136), second-inductor means (152), and third capacitor means (154) connected in series with said second inductor means (152) between said line (134) and said second capacitor means (156) first end.

2. A ballast circuit for driving at least one gaseous discharge lamp (224), the ballast circuit comprising in combination:

means for developing a DC power-supply potential (260) with respect to a circuit common (236);

an oscillator (216) for generating a high-frequency oscillator signal (230);

a line (234);

a transistor (218) connected to said oscillator (216), to said line (234), and to said circuit common (236), said transistor being configured as a switch responsive to said oscillator generated signal (230) and operative to periodically couple said line (234) to said circuit common (236); and a current-limiting network (220) including, first inductor means (240) connected between said DC power-supply potential (260) and said line (234), first capacitor means (250) connected between said line (234) and said circuit common (236), second capacitor means (256), second inductor means (252) connected in series with said second capacitor means (256) between said line (234) and said circuit common, third capacitor means (254) having a first end for connection with the lamp (224) and a second end connected to the juncture of said second capacitor means (256) and said second inductor means (252).

3. A ballast circuit for driving at least one gaseous discharge lamp (324), the ballast circuit comprising in combination:

means for developing a DC power-supply potential (360) with respect to a circuit common (336);

an oscillator (316) for generating a high-frequency oscillator signal (330);

a line (334);

a transistor (318) connected to said oscillator (316), to said line (334), and to said circuit common (336), said transistor being configured as a switch responsive to said oscillator generated signal (33) and operative to periodically couple said line (334) to said circuit common (336); and a current-limiting network (320) including, first inductor means (340) having a primary winding (344) connected between said DC power-supply potential (360) and said line (334) and a secondary winding (346) employing a first end and a second end, first capacitor means (350) connected between said line (334) and said circuit common (336), second capacitor means (356) for connection with the lamp (324), said second capacitor means having a first end and a second end connected to said first inductor means second winding (346) second end, second inductor means (352), and third capacitor means (354) connected in series with said second inductor means (352) between said first inductor means second winding (346) first end and said second capacitor means (356) first end.

4. A ballast circuit for driving at least one gaseous discharge lamp (424), the ballast circuit comprising in combination:

means for developing a DC power-supply potential (460) with respect to a circuit common (436);

an oscillator (416) for generating a high-frequency oscillator signal (430);

a line (434);

a transistor (418) connected to said oscillator (416), to said line (434), and to said circuit common (436), said transistor being configured as a switch responsive to said oscillator generated signal (430) and operative to periodically couple said line (434) to said circuit common (436); and a current-limiting network (420) including, first inductor means (440) having a primary winding (444) connected between said DC power-supply potential (460) and said line (434) and a secondary winding (446) employing a first end and a second end, first capacitor means (450) connected between said line (434) and said circuit common (436), second capacitor means (456 or 1056), second inductor means (452 or 1052) connected in series with said second capacitor means (456 or 1056) between said first inductor means second winding (446) first end and said first inductor means second winding (446) second end, third capacitor means (454 or 1054) for connection with the lamp (424) between said first inductor means second winding (446) second end and the juncture of said second capacitor means (456 or 1056) and said second inductor means (452 or 1052).

5. A ballast circuit as recited in claim 4 wherein said transistor includes a gate connected to said oscillator (416) and a channel having a first end connected to said line (434) and a second end connected to said circuit common (436).

6. A ballast circuit as recited in claim 4 wherein said transistor is of the type which is commonly designated IRF830.

7. A ballast circuit as recited in claim 4 wherein said oscillator is of the free-running type.

8. A ballast circuit as recited in claim 4 wherein said ballast circuit further comprises two series connected gaseous discharge lamps (424) the combination connected in series with said third capacitor means (454 of 1054) between said first inductor means second winding (446) second end and said juncture of said second capacitor means (456 or 1056) and said second inductor means (452 or 1052).

9. A ballast circuit for providing AC power for driving at least one gaseous discharge lamp (124, 224, 324, 424, or 524), the ballast circuit comprising in combination:

means for developing a DC power-supply potential (160, 260, 360, 460, or 586) with respect to a circuit common (136, 236, 336, 436, 736, or 836);

an oscillator (116, 216, 316, 416, or 516) for generating a high-frequency oscillator signal (130, 230, 330, 430, or 630);

a line (134, 234, 334, 434, 734, or 834);

a transistor (118, 218, 318, 418, 518, 818, or 918) connected to said oscillator, to said line, and to said circuit common, said transistor being configured as a switch responsive to said oscillator generated signal and operative to periodically couple said line to said circuit common; and a current-limiting network (120, 220, 320, 420, 520, 820, 920, or 1020) including, a first node (134, 234, 364, 464, or 764), a second node (136, 236, 366, 466, or 766), first inductor means (140, 240, 340, 440, 740, or 840) connected to couple said DC power-supply potential to said line and connected to develop a predetermined inductive reactance between said first and said second nodes, second inductor means (152, 252, 352, 452, or 752), and first capacitor means (156, 256, 356, 456, or 756), connected in series with at least said second inductor means between said first and said second nodes, AC voltage for driving at least said lamp being developed across said first capacitor means.

* * * * *